United States Patent [19]

Trovato et al.

[11] Patent Number: 4,940,289

[45] Date of Patent: Jul. 10, 1990

[54] SCABBLER FOR SCABBLING FLOORS CONTAMINATED WITH HAZARDOUS MATERIALS

[76] Inventors: Stephen A. Trovato, 37 Puddingstone Dr., Boonton, N.J. 07005; Sheldon Lefkowitz, 119 Lang Dr., Coraopolis, Pa. 15108; Robert J. Eckert, R.D. 1, Box 41, Eighty-four, Pa. 15330

[21] Appl. No.: 200,937

[22] Filed: Jun. 1, 1988

[51] Int. Cl.[5] ..... B25D 9/04; B25D 17/32

[52] U.S. Cl. ..... 299/37; 29/81.14; 173/24; 299/64

[58] Field of Search ..... 299/37, 38, 64, 67, 299/69; 173/24, 22; 29/81 D, 81 G; 175/213

[56] References Cited

U.S. PATENT DOCUMENTS

| | | | |
|---|---|---|---|
| 2,303,726 | 12/1942 | Dettloff et al. | 173/22 X |
| 2,553,435 | 5/1951 | Briese | 173/24 X |
| 2,562,899 | 8/1951 | Finn | 173/24 X |
| 3,366,420 | 1/1968 | Young | 299/37 |
| 4,594,759 | 6/1986 | Ikeda | 29/81 D |

FOREIGN PATENT DOCUMENTS

| | | | |
|---|---|---|---|
| 531835 | 8/1958 | Italy | 299/37 |
| 734897 | 8/1955 | United Kingdom | 29/81 |
| 2010163 | 6/1979 | United Kingdom | 29/81 D |

OTHER PUBLICATIONS

Pentex Inc., "The Moose from Pentek", Nov. 1985, 3 pages.

"MacDonald Scabblers", MacDonald Air Tool Corp., 4 pages.

*Primary Examiner*—Hoang C. Dang

*Attorney, Agent, or Firm*—Brooks, Haidt, Haffner & Delahunty

[57] ABSTRACT

A manually steerable machine for scabbling areas which are relatively inaccessible to larger machines is disclosed. Three pneumatically operable piston and cylinder assemblies with bits are mounted on a plate which is mounted in vertically movable relationship on a frame, the assemblies being disposed at the apices of a triangle, one of the apices being at the forward end of the frame and the other apices being rearwardly of the one of the apices. A tiltable handle extends from the rear end of the frame and upwardly from the frame and includes an air manifold and an air valve for supplying compressed air to the assemblies through hoses. A pair of wheels at the rear of the frame support the frame when the pistons are not operating. A skid plate is attached to the bottom of the frame, and the bits are encircled by a flexible skirt extending downwardly from the frame. A vacuum hose connector has its lower end at the bottom of the frame and between the bits to collect dust.

18 Claims, 4 Drawing Sheets

Air Supply
1
2
3
4
5
6
7
8
9
10
11
12
13
14
15
26
27
29
30
33
34

SCABBLER FOR SCABBLING FLOORS CONTAMINATED WITH HAZARDOUS MATERIALS

This application is related to the co-pending application Ser. No. 115,780 filed Oct. 30, 1987, entitled "Collecting and Packaging Hazardous Particulate Materials", now abandoned and in the names of Victor H. Nutter and Howard G. Baker.

FIELD OF THE INVENTION

This invention relates to apparatus for the scabbling of surfaces and collecting and packaging of hazardous particulate materials, such as radiation or chemically contaminated dust. More particularly, the invention relates to apparatus for removing a layer of contaminated material from a surface which is relatively inaccessable to larger machines, such as surfaces near walls or in a corner of a room, beneath obstacles such as pipes, etc.

BACKGROUND OF THE INVENTION AND THE PRIOR ART

Although it may have other uses, the invention was made during attempts to improve the performance of a dust collecting vacuum device used for decontaminating concrete floor surface areas within the radiologically controlled areas of a nuclear power plant and will therefore be described in connection with such use.

When surface coatings and other deposits on concrete floors must be removed, or the floor needs resurfacing, it is common to remove anywhere from 1/32" to 3/16" of the thickness of the floor surface by scabbling using hand tools, or preferably, a mobile vehicle on which a scabbling head is mounted. The scabbling of the surface pulverizes the concrete to that depth by rapidly repeated hammer blows of the scabbler pistons which are driven by compressed air and carry tungsten carbide tipped bits. Such pulverizing would produce airborne dust were it not collected by an efficient vacuuming system as it is produced. In nuclear power plants, such scabbling is used to remove radiation-contaminated floor coatings, and it is apparent that the created dust is extremely hazardous. If not efficiently and safely removed, the floor-scraping personnel and others within the area will be subjected to harmful radiation.

Considering the dangerous environment, a remotely operated scabbler vehicle has been devised having an efficient vacuum collection system thereon for removal and temporary storage of the generated dust in a waste bin also mounted on the vehicle. This self-powered and skid-steered six-wheel vehicle is available from Pentek, Inc. of Pittsburgh, Pa., under the trademark, "The Moose". However, the on-board waste bin must be emptied when filled, which unavoidably causes release of at least some contaminated dust into the surrounding air, which prevents the desired complete decontamination of the area being cleaned. Furthermore, because of the size of such machine, it is not possible to use it for some surfaces, such as surfaces near walls or in corners or below obstacles.

OBJECTS AND BRIEF SUMMARY OF THE INVENTION

Accordingly, it is intended by the present invention to provide apparatus for vacuum collecting and directly packaging such hazardous particulate material or dust within an easily removable and sealable container for convenient disposal. The container is preferably itself disposable for the purpose. The apparatus is of a size and the scabbler pistons are so disposed that the apparatus can reach into corners, close to walls and below some obstacles on a wall which are spaced from the adjacent floor.

Further, it is intended that virtually none of the collected hazardous dust will be released into the surrounding air either during its travel from the vacuum system into the container, or upon or after removing the filled container.

The apparatus of the invention comprises three vertically acting, scabbler pistons disposed adjacent to the apices of a triangle with one apex being forwardmost with respect to a steering handle. The handle is secured to a rearward portion of a frame which carries the cylinders for the pistons in vertically movable relation thereto, and there is a skid plate beneath the frame. The cylinders for the pistons are mounted on a plate above the frame which is vertically movable with respect to the frame. A perforate skirt, such as a brush, extends downwardly from the frame so as to be engagable with the floor to prevent dust particles from flying outwardly from the pistons. A vacuum hose connection extends upwardly from the frame to permit connection of the machine by means of a hose to the vacuum and container system described in said application.

The frame is mounted on a pair of wheels at the rearward portion thereof so that the frame may be tilted and the machine may be moved on the wheels from place-to-place without contact of the piston heads with the floor. However, without tilting of the frame, the piston heads lie substantially in a plane parallel to a floor, and the heads engage the floor.

At the upper end of the handle, there is a manually operable valve and a hose connection for supplying air under pressure to the cylinders for the pistons by way of hoses extending from the upper end of the handle to the cylinders.

The weight of the machine is selected so that when the pistons are operating, the machine "floats" making it easy to steer the machine to the desired floor areas and reducing fatigue of an operator. The machine is provided with weights secured to the cylinders having the pistons for opposing the forces of the pistons and for providing the desired weight.

DETAILED DESCRIPTION OF THE PREFERRED EMBODIMENT

These and other objects, features and advantages of the invention will be readily apparent from the following detailed description thereof, which makes reference to the accompanying drawings in which.

Figures 1, 2:
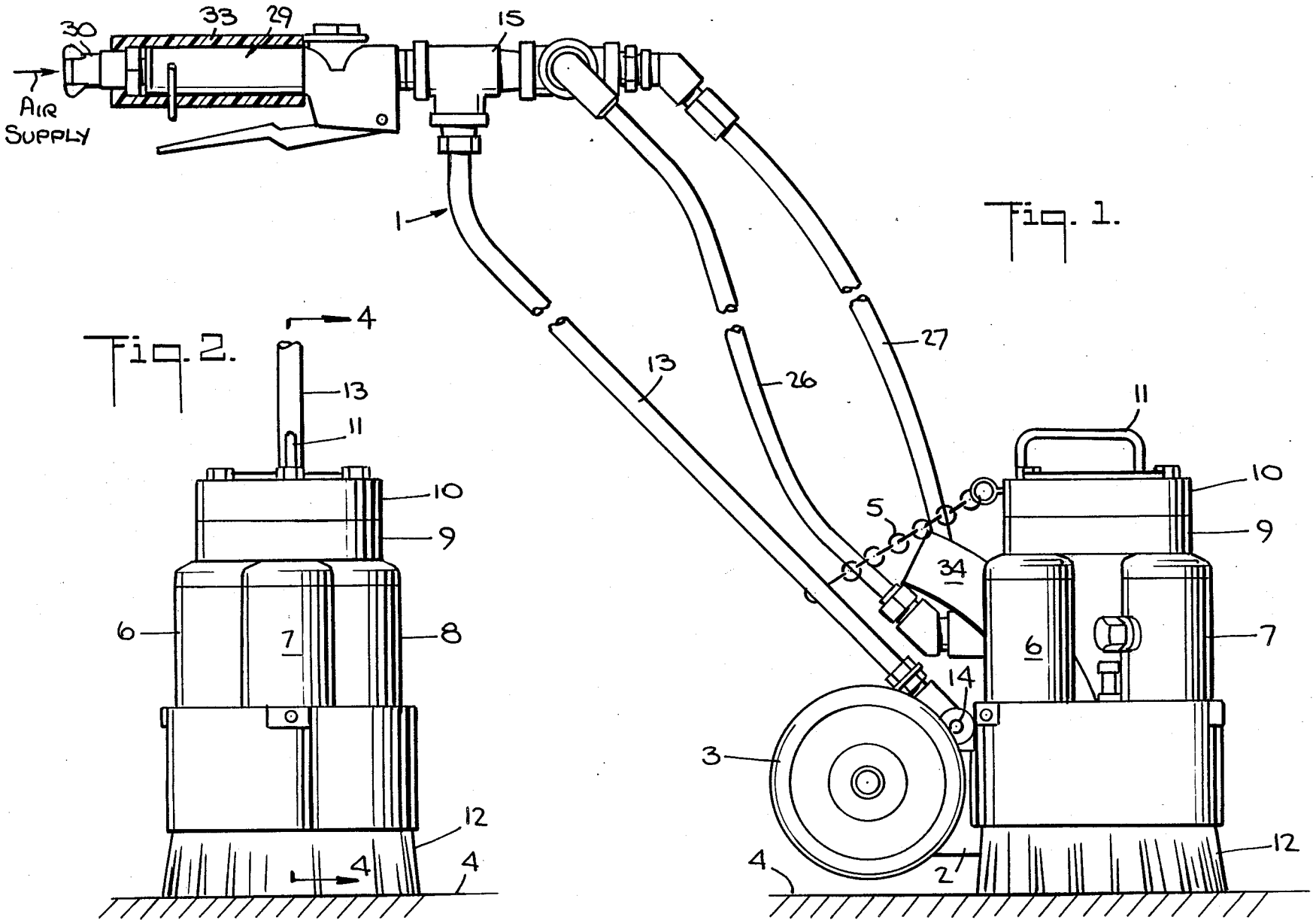
FIG. 1 is a side elevation view of the scabbling machine of the invention with the pistons in their lowermost positions.
FIG. 2 is a fragmentary front view of the scabbling machine shown in FIG. 1.
Figure 3:
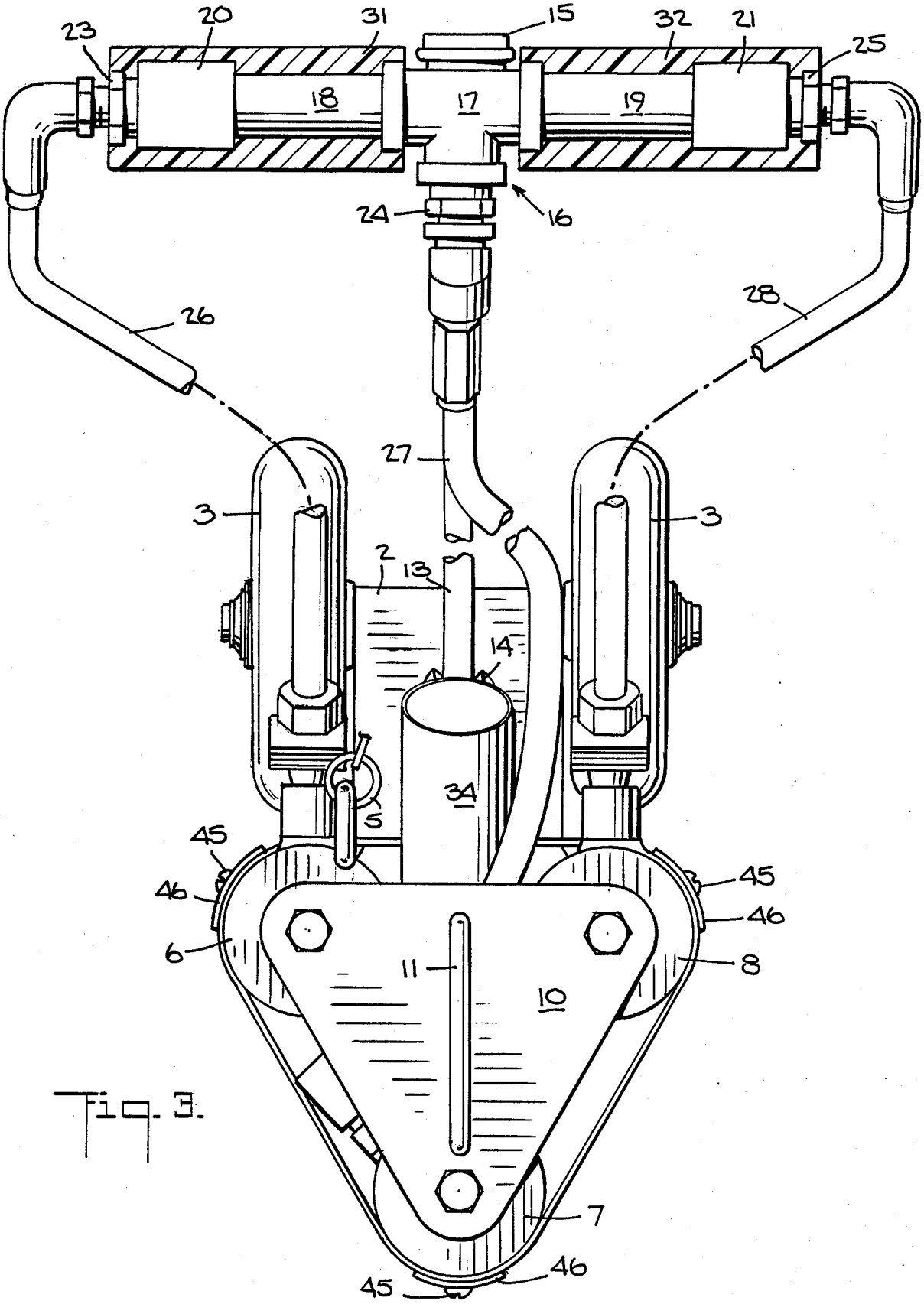
FIG. 3 is a top view of the scabbling machine shown in FIGS. 1 and 2.

Referring to FIGS. 1–3, the scabbling machine of the invention comprises a handle 1 pivotally secured at its lower end to a frame 2 (see also FIG. 6) with transporting means in the form of a pair of wheels 3 rotatably mounted thereon. As indicated in FIG. 1, the wheels 3 do not touch a floor 4 being scabbled when the scabbling machine is in operation but the wheels can touch the floor during operation, if desired. However, the pivotable handle 1 is connected to the upper part of the machine, such as by a detachable flexible chain 5, so that by pivoting the handle 1 counterclockwise, as viewed in FIG. 1, the wheels 3 will engage the floor 4 permitting the machine to be carried by the wheels 3 for transport of the machine without engagement of the piston heads (hereinafter described) with the floor 4.

The machine has three scabbling cylinders 6, 7 and 8 with pneumatically operable pistons of a known type, such as scabbling pistons and cylinder assemblies sold by MacDonald Air Tool Corp., 242 West Street, So. Hackensack, N.J., and further described hereinafter. Such assemblies are disposed at the apices of an equilateral triangle with one apex nearest the forward end of the frame 2.

A pair of weights 9 and 10, e.g. plates of steel having a weight depending upon the size of the machine, are secured to the tops of the cylinders 6–8 to counterbalance, with the weight of the other components of the machine, the upward forces produced by the pistons (see FIG. 4) when they are operated and the heads thereof engage the floor 4 and thereby, to cause a "Floating" action which makes it easier to move the machine and reduces operator fatigue. A lifting handle 11 is secured to the weight 10.

A perforate, flexible skirt 12, such as a nylon brush, is secured to and encircles part of the frame 2 and extends to the floor 4 to prevent dust caused by the pistons 6–8 from flying out from under the machine during operation thereof and to protect an operator's feet. However, the skirt 12 permits air to flow therethrough and into the space enclosed thereby.

The handle 1 comprises a rod 13 pivotally secured at its lower end to the frame 2 by a clevis 14 and secured at its upper end to a pipe-T 15. The pipe-T 15 is secured to a manifold 16 comprising a pipe-cross 17, nipples 18 and 19, couplings 20 and 21 and reducer bushings 23, 24 and 25. Air hoses 26, 27 and 28 extend from the bushings 23–25 to, respectively, the cylinders 6, 7 and 8.

Air under pressure, e.g. a pressure of 80 p.s.i.g., is supplied to the pipe-T 15, and hence, to the manifold 16, the hoses 26–28 and the cylinders 6–8, through a conventional, manually operable, throttle valve 29 which is connected to a hose (not shown) by a conventional connector 30 and which extends to the source of air under above atmospheric pressure, e.g. a pressure of 80 psig.

The valve 29, the couplings 20 and 21, and the nipples 18 are covered with resilient cushioning tubes 31, 32 and 33, such as tubes of foamed plastic, for comfort in gripping the handle 1 and to help isolate vibration from the operator's hands.

A tubular vacuum hose connector 34 extends to an opening in the frame 2 and preferably, is connected to the flexible vacuum hose 35 (see FIG. 4) described in said application, such vacuum hose extending to the vacuum head described in said application so that any dust is connected described therein. However, if desired, the connector 34 may be connected to another vacuum collecting system which provides a vacuum flow of 60–90 cfm.

Figure 4:
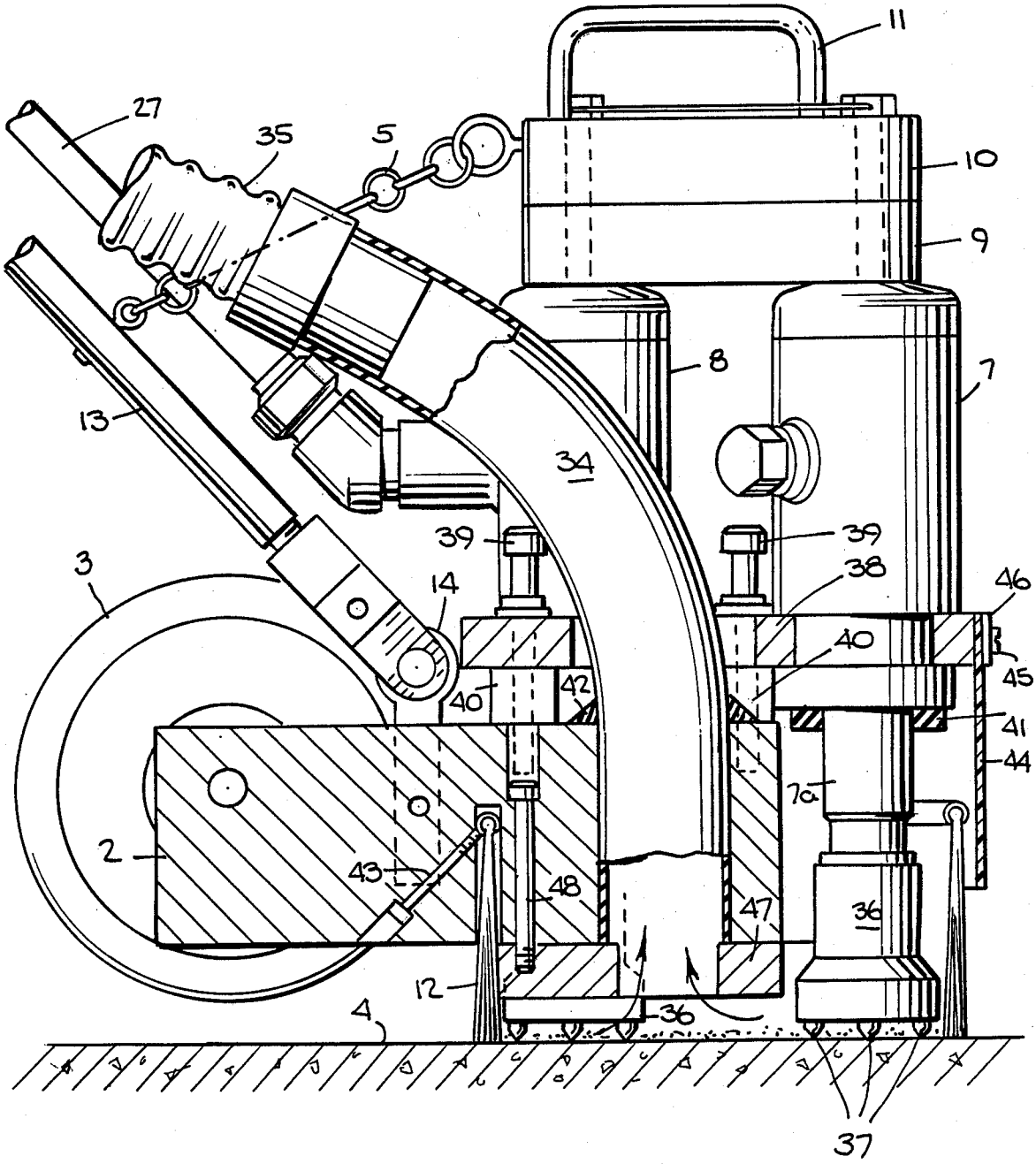
FIG. 4 is a fragmentary, enlarged, side elevation view, partly in cross section, of the scabbling machine shown in the preceding Figures and is taken along the line 4—4 indicated in FIG. 2.

With reference to FIG. 4, the cylinders 6–8 with their pistons are identical, and cylinder 7, for example, has a piston 7*a* which carries a bit 36 with a plurality of tungsten-carbide teeth 37. Each cylinder 6–8 is secured to a steel upper plate 38 (see also FIG. 7) which is free to move vertically on shoulder screws or guides 39 threaded into the frame 2 but which is limited in its downward movement by spacers 40 between the plate 38 and the frame 2, which spacers determine the depth of scabbling. Upward movement of the plate 38 is limited by the shoulders at the upper ends of the screws 39. Such mounting of the cylinders 6–8 reduces the transmission of vibrations to the handle 1. Rubber seals, such as the seal 41, encircle each piston. A rubber seal 42 encircles the hose connector 34 and engages the frame 2.

The skirt or brush 12 is received in grooves in the frame 2 and is secured to the frame 2, such as by screws 43 only one of which is shown in FIG. 4. A rubber cover 44 is secured to the upper plate 38, such as by the screws 45 and the clamping plates 46 (see FIGS. 3 and 4), extends downwardly over the frame 2 and encircles the portion of the frame 2 through which the pistons pass.

A skid plate 47 (see FIGS. 4 and 5), which can be of hardened steel, is secured to the lower side of the frame 2, such as by screws, one of which is designated by the numeral 48 in FIG. 4. FIG. 4 illustrates the skid plate 47 above the floor 4 and the bits 36 in their lowermost positions for ease in illustration, but when the bits 36 are not in operation and not in their lowermost positions, the skid plate 47 engages the floor 4. However, the weight of the apparatus is such that when a scabbling operation is being performed, the upward forces of the pistons causes the skid plate 47 to be intermittently raised from the floor 4 as shown in FIG. 4.

Figure 5:
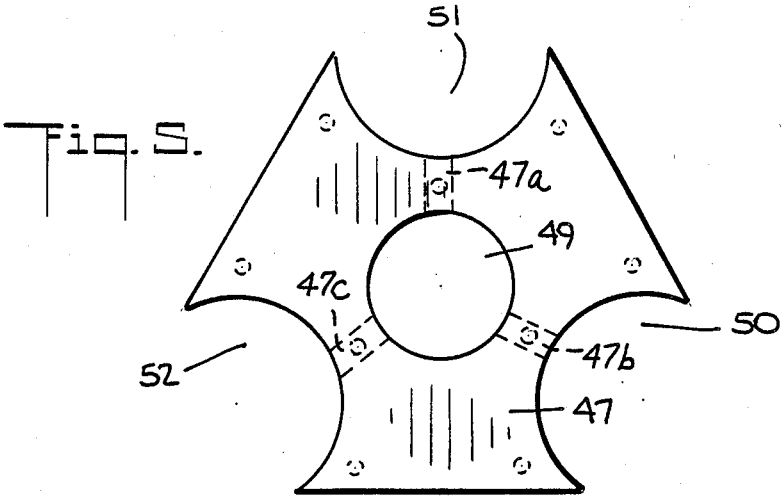
FIGS. 5–7 are plan views of respectively, the skid plate, frame and upper plate forming part of the scabbling machine of the invention.

The skid plate 47 is also shown in FIG. 5 and has a central opening which is disposed below the lower end of the hose connector 30. The plate 47 also has three arcuate portions 50–52 of a radius greater than the radius of the bits 36 for the passage of the bits 36. The plate 47 can have three grooves 47*a*–47*c* extending from the arcuate portions 50–52 to the central opening for the removal of dust.

Figure 6:
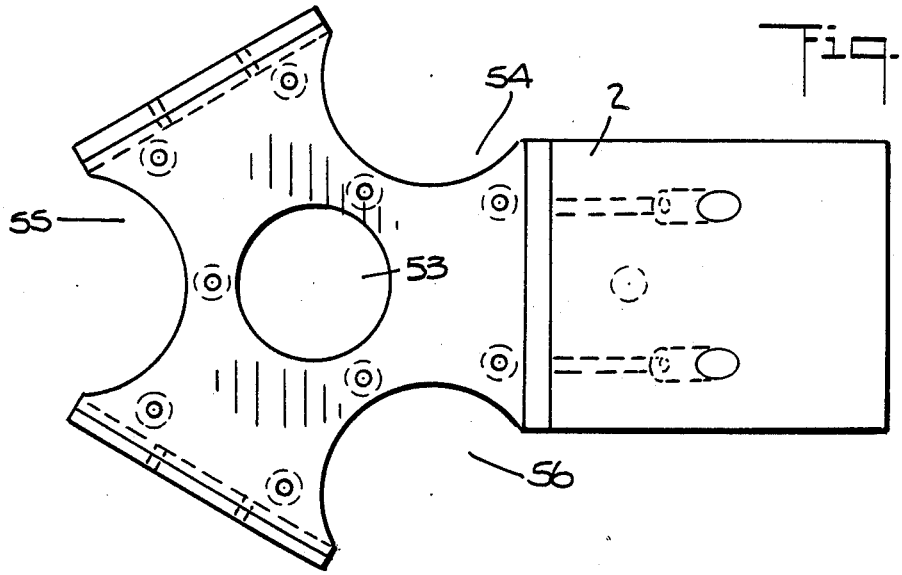

The frame 2 is also shown in FIG. 6 and has an opening 53 for receiving the lower end of the hose connector 30. The frame 2 also has three arcuate portions 54–56 for the free passage of the piston rods, one of which is designated by the numeral 7*a* in FIG. 4 and the bits 36 (see FIG. 4).

Figure 7:
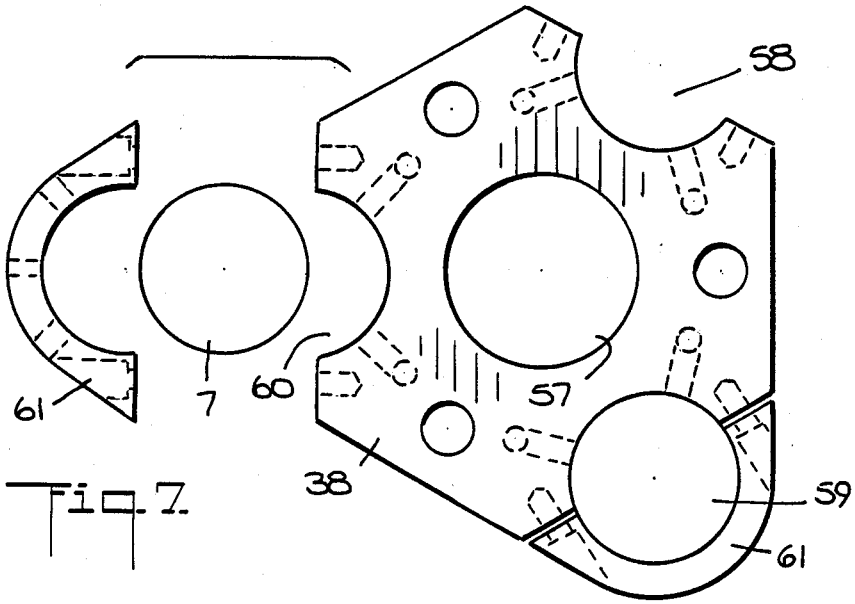

FIG. 7 also shows the upper plate 38 which has an opening 57 for the passage of the vacuum hose connector 34 and arcuate portions 58, 59 and 60 for receiving the cylinders 6–8. The cylinders 6–8 are secured to the upper plate 38 by clamps, such as the clamps 61.

In one preferred embodiment of a scabbling machine of the invention, the machine had the following characteristics:

| | |
|---|---|
| Width | 6 inches |
| Height | 12 inches (excluding handle) |
| Length | 12 inches (excluding handle air supply hose and vacuum hose) |
| Weight | 65 pounds (including handle) |

-continued

| | |
|---|---|
| Bits | 3 bits with centers equally spaced on circle of 2¼ in. radius and each with 9 tungsten carbide teeth |
| Air consumption | 45–60 scfm at 80 psig |
| Vacuum flow | 60–90 cfm if contaminated dust and debris control is desired |
| Cylinder-piston assemblies | 3 MacDonald Air Tool Corp., Model HS without handle |

The scabbling machine is moved to a site to be scabbled by the lifting handle 11 or by tilting it by the handle 1 and causing the wheels 3 to engage the floor.

When the source of compressed air is connected to the connector 30 and the vacuum source is connected to the connector 34, the scabbling bits 36 are set into vertical reciprocating motion by operation of the throttle valve 29. The bits 36 will reciprocate at a high speed, e.g. 1200 times a minute and will cause the machine to rise, intermittently raising the skid plate and the wheels 3 off the floor 4 and thereby, creating a "floating" action. The bits 36 are then guided over the surfaces to be scabbled by the handle 1.

Although preferred embodiments of the present invention have been described and illustrated, it will be apparent to those skilled in the art that various modifications may be made without departing from the principles of the invention.

We claim:

1. Scabbling apparatus comprising:

a frame having a forward end, a rearward end and two opposed side surfaces extending divergently from said forward end toward said rearward end at an angle less than 180°;

a plurality of pneumatically operable scabbling piston and cylinder assemblies with reciprocable pistons and scabbling bits mounted on said pistons, said assemblies being carried by said frame and being mounted with said pistons reciprocable vertically and with said bits below said frame, and said assemblies being mounted with a single one thereof nearer the forward end of said frame than the remainder of said assemblies;

a handle secured to said frame and extending upwardly and rearwardly of said frame for manually moving said apparatus over a surface to be scabbled;

means for interconnecting said assemblies with a source of air supplying air at a pressure above atmospheric pressure for supplying such air to said assemblies for reciprocating said pistons; and a tubular vacuum hose connector for receiving a vacuum hose extending from a source of vacuum, said connector extending at least to the bottom of said frame with the bottom end of said connector disposed adjacent to and intermediate said assemblies for vacuum removal of dust created by operation of said assemblies in a scabbling operation.

2. Scabbling apparatus as set forth in claim 1 wherein there are three scabbling piston and cylinder assemblies and said single one of said assemblies is one of said three assemblies and said remainder of said assemblies are the remaining two of said assemblies.

3. Scabbling apparatus as set forth in claim 2 wherein said three scabbling piston and cylinder assemblies are disposed at the apices of an equilateral triangle having one apex nearest said forward end of said frame and having the remaining apices equidistant from said forward end of said frame.

4. Scabbling apparatus as set forth in claim 1 further comprising transporting means rotatably mounted on said frame rearwardly of said scabbling piston and cylinder assemblies for engaging a surface to be scabbled, said apparatus being free of rotatable transporting means other than transporting means rearwardly of said scabbling piston and cylinder assemblies.

5. Scabbling means as set forth in claim 4 wherein said handle is pivotally secured to said frame and further comprising flexible and inextensible when rectilinear means interconnecting said handle and said frame for permitting movement of the upper portion of said handle toward said forward end of said frame and limiting movement of said upper portion of said handle away from said forward end of said frame whereby said frame may be tilted around said transporting means to raise said bits with respect to a surface engaged by said transporting means.

6. Scabbling apparatus as set forth in claim 4 wherein said transporting means is a pair of wheels spaced apart less than the width of said frame in the direction transverse to the direction from said rearward end to said forward end of said frame.

7. Scabbling apparatus as set forth in claim 1 further comprising a plate disposed above said frame, said plate being mounted on said frame for free vertical movement with respect to said frame but within spaced upper and lower limits and means securing said scabbling piston and cylinder assemblies to said plate for movement therewith.

8. Scabbling apparatus as set forth in claim 7 further comprising a weight in addition to said plate, said means securing said scabbling piston assemblies to said plate and said means for interconnecting said assemblies with a source of air secured to the upper end portions of the cylinders of said scabbling piston and cylinder assemblies for opposing the upward forces of said pistons during reciprocation thereof.

9. Scabbling apparatus as set forth in claim 7 wherein said frame has openings therethrough for the free passage of said reciprocable pistons therethrough.

10. Scabbling apparatus as set forth in claim 7 further comprising a skid plate secured to the bottom of said frame, said skid plate having openings therethrough for the passage of said bits.

11. Scabbling apparatus as set forth in claim 1 further comprising a perforate skirt encircling at least part of said frame and extending downwardly from said frame a distance sufficient to engage a surface being scabbled during reciprocation of said pistons, said skirt encircling said bits.

12. Scabbling apparatus as set forth in claim 1 wherein said handle comprises an air manifold, a manually operable air valve connected to said manifold for controlled supply of air to said manifold and means for interconnecting said valve with a source of air under a pressure above atmospheric pressure and wherein said means for interconnecting said assemblies with a source of air comprises a plurality of air hoses, each of said hoses extending from said manifold to respective ones of said assemblies.

13. Scabbling apparatus as set forth in claim 10 wherein the weight of said apparatus is selected in relation to the upward forces applied thereto by said pistons, when said pistons are reciprocating and said bits engage a surface to be scabbled, so that said apparatus is supported by said bits and said ski plate moves away from said surface.

14. Scabbling apparatus as set forth in claim 6 wherein said wheels are disposed with respect to said frame so that with said pistons and said bits reciprocating and in contact with a surface to be scabbled, said wheels are out of contact with said surface.

15. Scabbling apparatus as set forth in claim 1 wherein said angle is 60°.

16. Scabbling apparatus as set forth in claim 10 wherein said skid plate has a central opening therethrough below said vacuum hose connector and has grooves extending from said openings to said central opening for the removal of debris from adjacent said bits.

17. Scabbling apparatus comprising:

a frame having a forward end, a rearward end, an upper surface, a lower surface, a pair of opposed side surfaces and a plurality of spaced openings therethrough;

a plurality of guides extending upwardly from the upper surface of said frame and having their lower ends secured to said frame;

a plate disposed above said upper surface, said plate having openings therethrough receiving said guides and being free to slide vertically on said guides;

a plurality of pneumatically operable scabbling piston and cylinder assemblies having cylinders, reciprocable pistons and scabbling bits, said cylinders being secured to said plate and out-of-contact with said frame, with one of said cylinders nearer the forward end of said frame than others thereof and with the pistons thereof extending through respective ones of said openings on said frame, said pistons having a size smaller than said openings in said frame to permit the free passage of said pistons through said openings and said scabbling bits being disposed below said lower surface of said frame;

a handle secured to said frame and extending upwardly and rearwardly of said frame for manually moving said apparatus over a surface to be scabbled;

means for interconnecting said assemblies with a source of air supplying air at a pressure above atmospheric pressure for supplying such air to said assemblies for reciprocating said pistons; and a tubular vacuum hose connector for receiving a vacuum hose extending from a source of vacuum, said connector extending at least to the bottom of said frame with the bottom end of said connector disposed adjacent to said assemblies for vacuum removal of dust created by operation of said assemblies in a scabbling operation.

18. Scabbling apparatus as set forth in claim 17 further comprising a weight connected to said plate for opposing upward movement thereof, said weight being selected to cause said plate and said assemblies to be supported by said bits with reciprocation of said pistons and thereby, reduce the weight on said frame.

* * * * *